United States Patent [19]

Hildebrandt et al.

[11] Patent Number: 4,461,519

[45] Date of Patent: Jul. 24, 1984

[54] CUPBOARD WITH METAL FRAMED SIDE WALLS

[76] Inventors: Norbert Hildebrandt, Grüner Winkel 32, D-4782 Erwitte 1; Norbert Becker, Weringhauser Strasse 15, D-4782 Erwitte 2, both of Fed. Rep. of Germany

[21] Appl. No.: 311,120

[22] Filed: Oct. 14, 1981

[30] Foreign Application Priority Data

Oct. 20, 1980 [DE] Fed. Rep. of Germany ..... 3039499

[51] Int. Cl.³ ..... E21B 47/00

[52] U.S. Cl. ..... 312/257 A; 52/220; 52/827; 312/223

[58] Field of Search ..... 312/196, 107, 111, 257 A, 312/257 SK, 223; 52/220, 221, 821, 827

[56] References Cited

U.S. PATENT DOCUMENTS

| | | | |
|---|---|---|---|
| 2,624,649 | 1/1953 | Greiling | 312/107 |
| 2,965,428 | 12/1960 | Jacobs et al. | 312/107 X |
| 3,819,245 | 6/1974 | Tacke et al. | 312/223 |
| 3,873,758 | 3/1975 | Van Gessel et al. | 312/223 |
| 3,883,201 | 5/1975 | Busoni | 312/223 |
| 4,066,305 | 1/1978 | Gazarek | 312/223 X |
| 4,094,256 | 6/1978 | Holper et al. | 312/223 X |
| 4,288,136 | 9/1981 | Le Mar | 312/257 SK |
| 4,296,981 | 10/1981 | Hildebrandt et al. | 312/223 |
| 4,323,291 | 4/1982 | Ball | 312/194 |
| 4,372,629 | 5/1983 | Propst et al. | 312/194 X |

*Primary Examiner*—William E. Lyddane
*Assistant Examiner*—Joseph Falk
*Attorney, Agent, or Firm*—Pollock, Vande Sande and Priddy

[57] ABSTRACT

With the continual increase in various kinds of technical office equipment, the problem arises of laying the necessary cables as far as possible out of sight. To this end, spaces for cable installations are to be provided in the side walls of cupboards. For this purpose, the side walls of cupboards consist of a metal frame (4) sandwiched between two cover plates (28; 29). The cover plates are screwed to the metal frame (4). Screwed to the metal Frame (4) is a U-section metal strip which is overlapped by a U-section cover strip (23) of resilient plastics material. A space is formed between the two cover plates for cable installations, which is accessible from the front of the cupboard.

10 Claims, 6 Drawing Figures

CUPBOARD WITH METAL FRAMED SIDE WALLS

BACKGROUND ART

Articles of furniture such as cupboards with metal framed side walls are already known, in which the metal frame surrounds a supporting side wall. Such cupboards are assembled by arranging a desired number of side walls, top and base boards in a row. A disadvantage of such constructions is the fact that these cupboards are not prepared for cable installations such as are required in large quantities these days in office furniture. Apart from this, the assembly of these multi-door cupboards is relatively complicated and, since the various parts of the cupboards need to be carefully mated, must be carried out by experienced persons.

DISCLOSURE OF THE INVENTION

The purpose of the invention is to provide an article of furniture such as a cupboard of the above mentioned type which is easy to assemble and which has prepared spaces in the side walls for cable installations.

This purpose is achieved according to the invention in that the metal frame is sandwiched between two cover plates which are screwed thereto, and that an outwardly open U-section metal strip is screwed to the edges of the metal frame and provided with an overlapping inwardly open U-section cover strip of resilient plastics material.

With such a construction there are not only sufficiently large ducts for cables along all the edges of the side walls, but also free space within the frame between the cover plates. This kind of construction can thus be utilised universally even for very difficult installation problems without having to make alterations to the parts.

According to another characteristic of the invention, the metal strips are assembled to the metal frame in sections and mountings for the hinges are screwed onto the metal frame; between the sections. By arranging in sections the metal strips which are overlapped by the cover strips in sections, it becomes particularly easy to secure the hinge mountings at practically any desired height. It is also possible to assemble the hinge mountings for neighbouring doors one above the other According to another characteristic of the invention, the metal frame is provided with screw channels arranged horizontally and vertically relative to the plane of the side wall, into which the securing screws for the cover plates are screwed.

According to a further characteristic of the invention, the vertical sides of the metal frame are provided with vertically extending screw channels for the screws which secure the horizontal sides of the frame thereto. Such a construction ensures a rapid assembly of the metal frame.

It has further proved advantageous to provide the arm of the hinge with a hairpin bend; whereby, when the door is open the outer end of the arm extends from the pivot on the mounting outside the cupboard and towards the outer side of the cupboard. When the door is closed the arm extends in the opposite direction between the pivot and the metal frame. The outer end of the arm is secured by means of screws to a securing plate on the door. With this construction, a particularly wide access spacing of the open door is achieved using an uncomplicated hinge. The available space between the sides as determined by the hinge is sufficiently large to ensure that drawers with side-mounted guides may be pulled out without damaging either the drawer or the door as would be the case with known types of hinge.

According to another characteristic of the invention, the securing plate of the hinge is provided with threaded bores arranged symmetrically to a plane through the center of the securing screws. This arrangement permits pre-assembly of the securing plates at a constant predetermined height on the doors irrespective of which hinge arm is to be secured thereto. According to a further characteristic of the invention, horizontally elongated slots are provided on the hinge arms and/or the securing plates. By means of these, horizontal adjustment of the doors is possible.

Finally it is suggested according to the invention that the pivot axes of the hinge mountings are offset relative to the central plane of the side walls. The asymmetrical arrangement of the axes allows assembly of the mountings in various positions, one above the other, so that the hinge arms at different heights can be secured to the securing plates at the same height on neighbouring doors.

BRIEF DESCRIPTION OF THE DRAWINGS

In the following, a preferred embodiment of the invention will be described in detail with the aid of the drawings, in which.

BEST MODE FOR CARRYING OUT THE INVENTION

Figure 1:
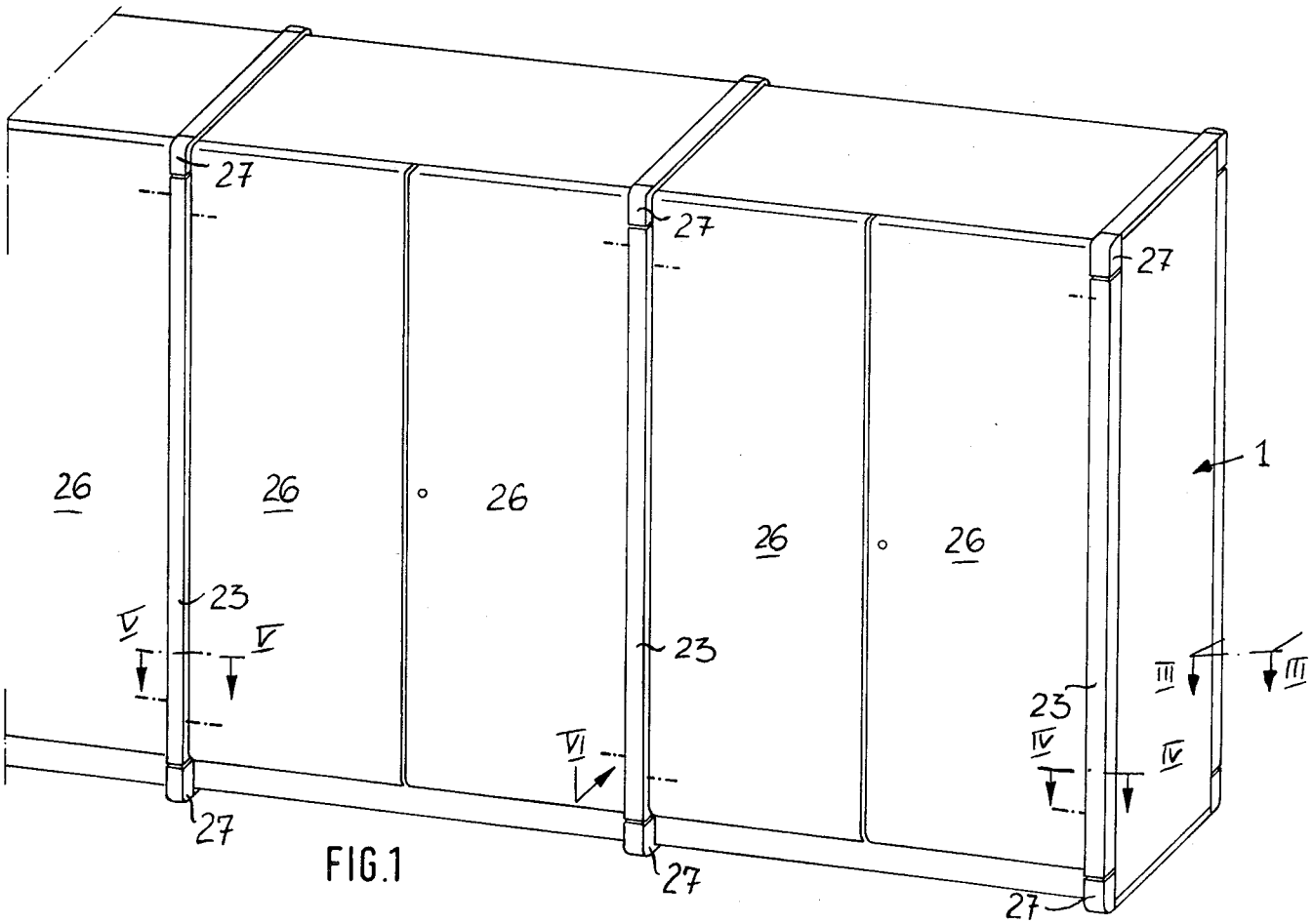
FIG. 1 shows a perspective view of a row of adjoining cupboards.

The cupboards which may be adjoined in rows all comprise side walls 1, doors 26, top boards 38 and base boards 37. The top boards 38 and base boards 37 are each pre-assembled together with the inner cover plates 28 to form a body frame.

On assembly, the sides of the pre-assembled body frame are inset in the metal frame 4. The metal frame 4 comprises vertical parts 5 and 6 and horizontal parts, for example note the lower horizontal part 7. Feet 8 are secured to the lower horizontal frame part.

As shown in FIGS. 3 to 6, lengths of metal strips 22 having outwardly opening U-shaped cross sections are screwed by their base to the vertical frame parts 5 and 6. Mountings 10 for the hinge 9 are secured by means of screws 35 and nuts 36 in spaces left free between the strips. Hairpin bent hinge arms 11 with elongated holes 12 at their outer ends are rotatably supported at their inner ends on a pivot 17 provided on the mountings 10. Securing screws 15 pass through the elongated holes and are screwed into the threaded bores 40. The threaded bores 40 are arranged one above the other in a securing plate 13 which is screwed with the aid of securing screws 14 to the inside of the door 26. If desired, securing plate 13 may be provided with elongated holes rather than threaded bores 40 and the outer ends of the hinge arm may be provided with threaded bores. The securing plate is symmetrically formed, as can best be seen in FIG. 6, so that the holes for screws 14 are located centrally and threaded bores 40 are equally spaced above and below. The securing plates 13 are assembled at the same heights on all the doors 26. The heights of the mountings 10 are so selected that when arranged one above the other, the hinge arms of neighboring hinges can be secured to the upper screw hole 40 on one side, and to the lower screw hole 40 on the other side.

The vertically extending pivot 17 of the hinge arm 11 on the mounting is offset in relation to a central plane taken through the securing screws 35 in the side wall. A cover plate 27 is fitted over the assembled securing plate 13 to hide the various securing screws thereon.

Figure 3:
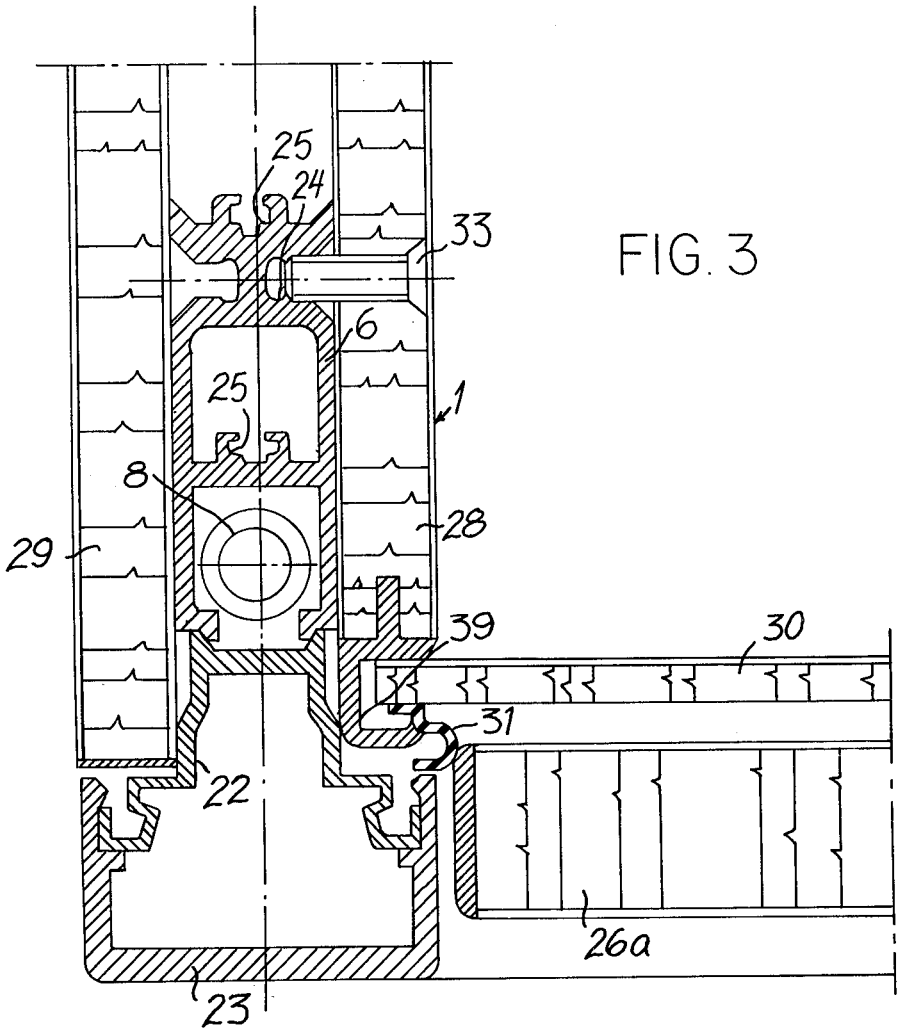
FIG. 3 shows a horizontal cross-section through the plane III—III in FIG. 1 of a rear corner.
Figure 4:
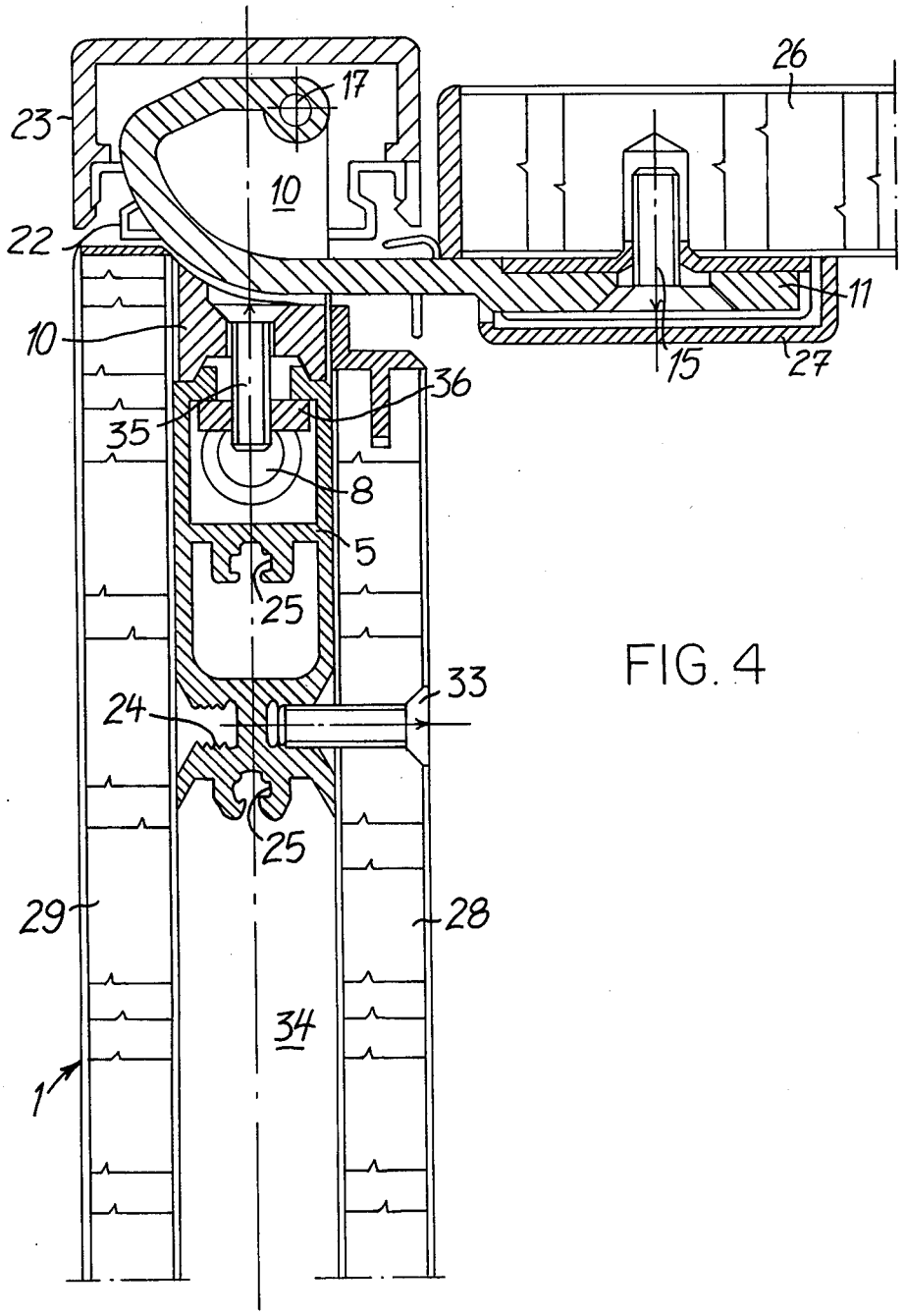
FIG. 4 shows a horizontal cross-section through the plane IV—IV of FIG. 1.
Figure 5:
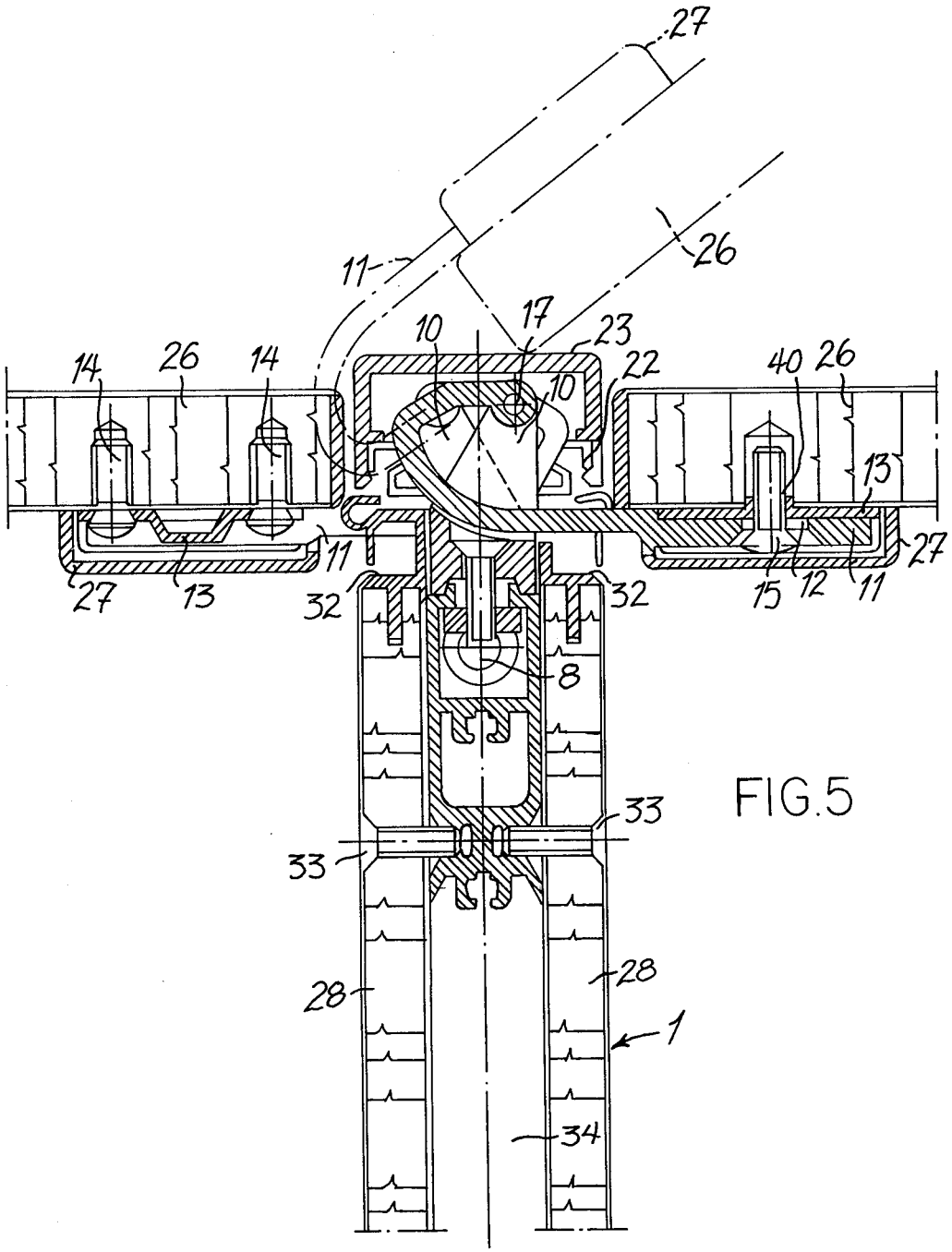
FIG. 5 shows a horizontal cross-section through the plane V—V of FIG. 1.
Figure 6:
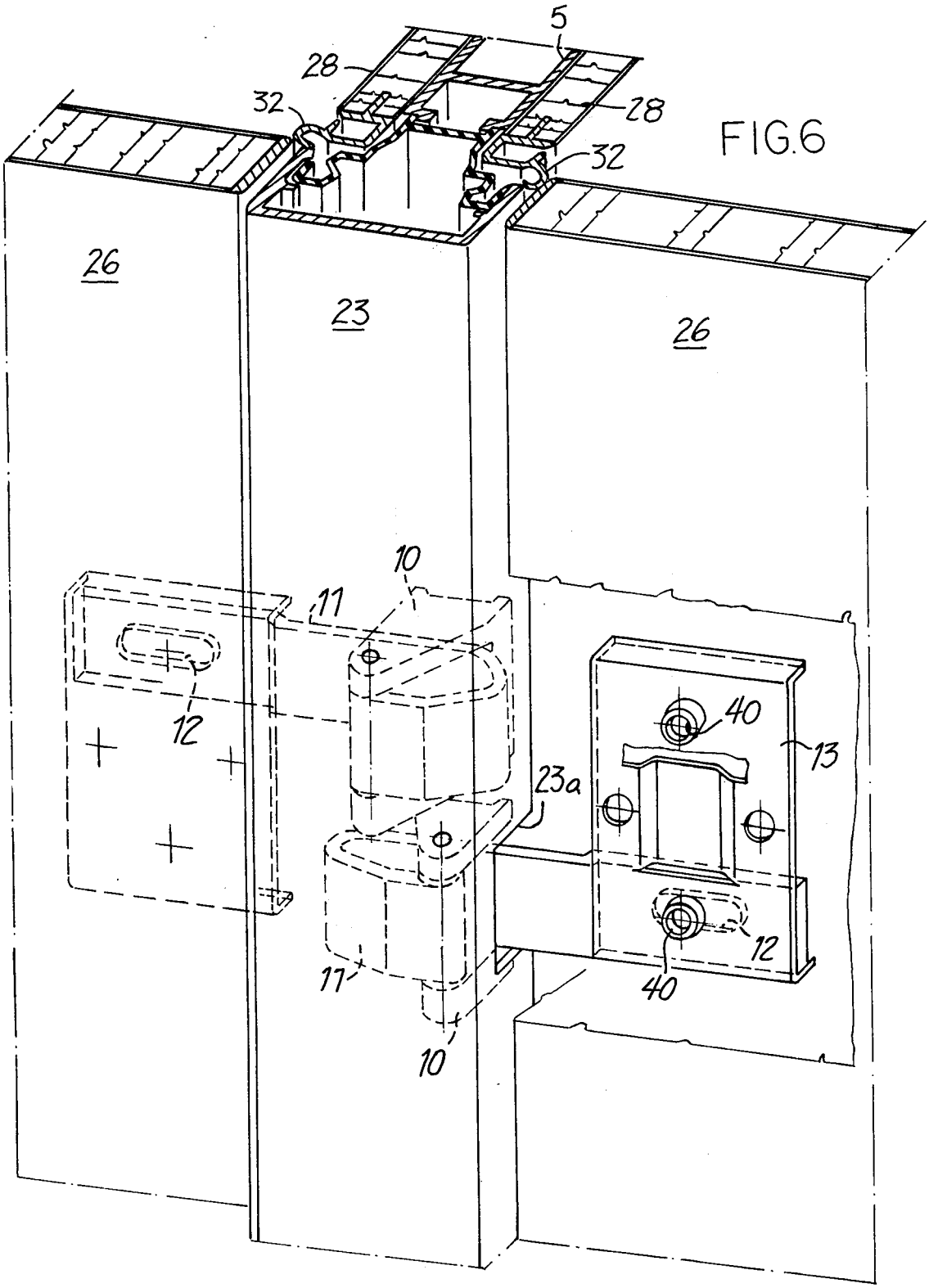
FIG. 6 shows a partly cut away perspective front view of the area VI in FIG. 1.

When the side wall 1 is to be the end wall of a row of cupboards, it is provided with an inner cover plate 28 and an outer cover plate 29. Whenever the side wall is to be followed by another cupboard, then the metal frame 4 is sandwiched between two inner cover plates 28. A space remains between the cover plates 28 or 29 in which electrical wiring cable installations may be laid. As shown in FIG. 3 the rear wall 30 is set in vertical recesses 39 provided at the back end of the inner cover plates. The rear cover plates **26*a* are in contact with a sealing strip 31**.

Sealing strips 32 provided at the front edge of the cover plates 28 are in contact with the closed doors 26.

Figure 2:
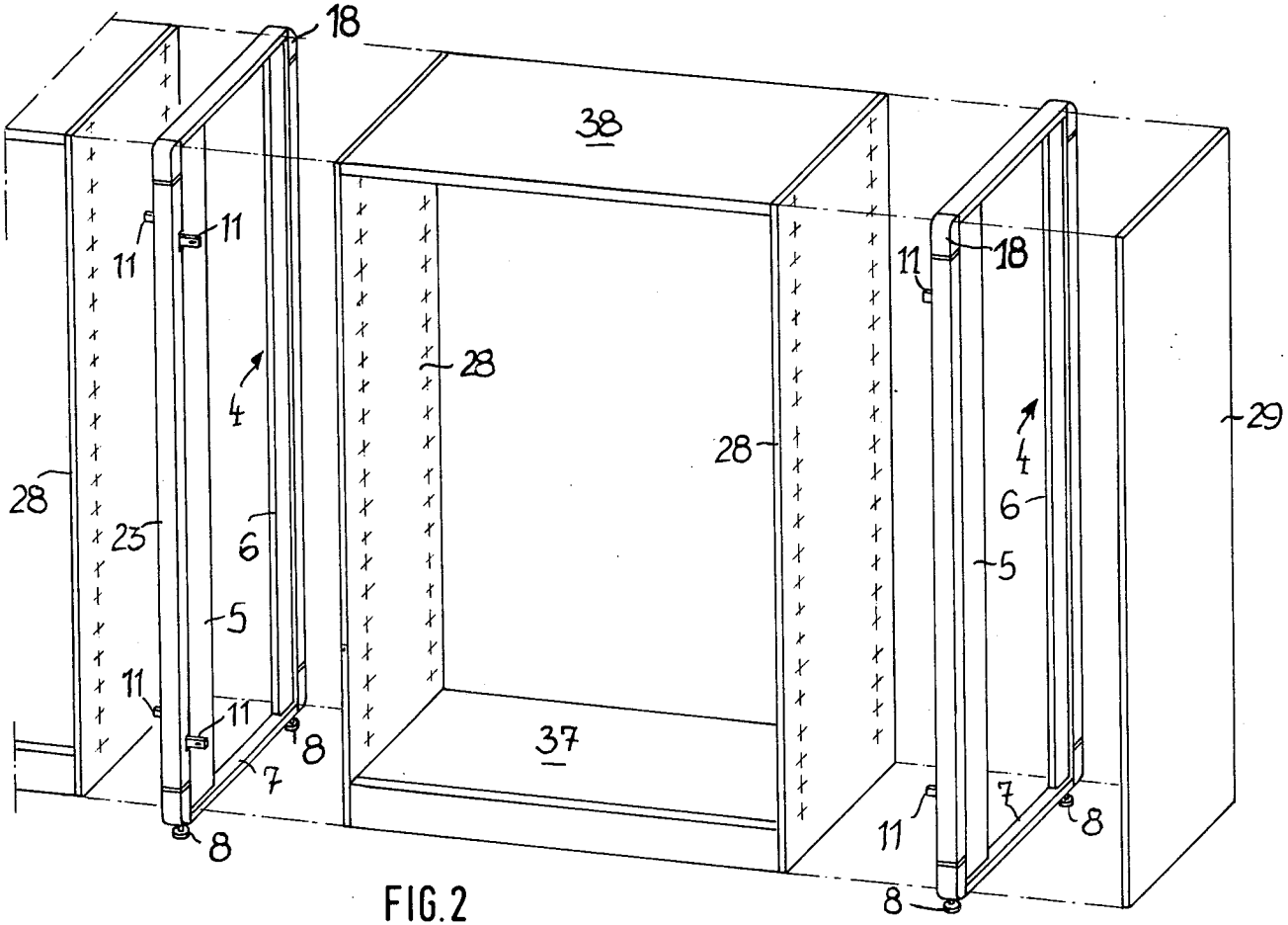
FIG. 2 shows a perspective exploded view of a cupboard with an adjoining part.

The open sides of metal strips 22 are closed by resilient plastic cover strips 23 having inwardly opening U-shaped cross sections whose side legs overlap the ends of the side legs of metal strips 22, as shown in FIG. 3. Plastic caps 18 are provided at the corners of cover strips 23, as shown in FIG. 2. On a level with the hinges, cut-out zones **23*a* are provided in the cover strips 23 for the passage of the hinge arms 11. Thus, between the two adjacent cover plates 28, or 28 and 29, there are spaces 34 which may be utilized for cable installations. Furthermore, cable ducts are formed between the metal strips 22 and the cover strips 23**.

The vertical frame parts 5 and 6 have horizontal screw channels 24 for receiving the securing screws 33 with which the cover plates 28 and 29 are screwed to the metal frame. Vertical screw channels 25 are provided in the vertical frame parts, which serve to receive the securing screws which connect the vertical frame parts to the horizontal frame parts.

We claim:

1. An improved article of furniture of the type having metal-framed side walls, wherein said side walls comprise:

a metal frame having spaced, vertically extending parts joined to spaced, horizontally extending parts;

inner and outer cover plates secured on respective sides to said metal frame by means of fasteners extending through said cover plates and engaging said metal frame, whereby said metal frame is sandwiched between said cover plate and a space is defined between said cover plates for receiving electrical wiring;

at least one metal strip secured to at least one vertical edge of said frame, said at least one edge facing outwardly from between said cover plates, said at least one metal strip having an open U-shaped cross section with outwardly extending side legs; and at least one resilient cover strip secured to said at least one metal strip, said at least one cover strip having an open, U-shaped cross section with inwardly extending side legs overlapping said outwardly extending side legs, whereby a further space is defined between said cover strip and said metal strip for receiving electrical wiring.

2. An improved article of furniture according to claim 1, wherein there are a plurality of said metal strips secured to an edge of one of said vertically extending parts, said strips being spaced at their ends, further comprising hinge means secured to said vertically extending part between said ends of said metal strips.

3. An improved article of furniture according to claim 2 further comprising at least one door; wherein said hinge means comprises a mounting member secured to said edge, a vertically extending pivot on said mounting member, and a hinge arm having inner and outer ends, said arm being rotatably mounted at said inner end on said pivot, said hinge arm having a hairpin bend between said inner and outer ends, and said outer end being secured to said door, said hinge arm extending when said door is open from said pivot outside said article of furniture and toward said outer cover plate and when said door is open in the opposite direction between said pivot and said frame.

4. An improved article of furniture according to claim 3, wherein said door comprises a securing plate for said outer end of said hinge arm, said securing plate comprising centrally located first means for securing said securing plate to said door and second and third means arranged symmetrically above and below said first means, for alternatively receiving further fasteners to secure said door to said hinge arm.

5. An improved article of furniture according to claim 4, wherein said hinge arm is provided with horizontally elongated holes at said outer end for receiving said further fasteners.

6. An improved article of furniture according to claim 3, wherein there are two of said hinge means attached to said vertically extending part, the pivots of said two hinge means being positioned on opposite sides of a vertical central plane of said side wall.

7. An improved article of furniture according to claim 3, wherein said metal strips comprise a base secured to said at least one edge between said outwardly extending side legs, further comprising at least one cut out zone in a side leg of said cover strip for passage of said hinge arm.

8. An improved article of furniture according to claim 1 wherein said fasteners are screws and said frame comprises threaded screw channels into which said screws are driven to secure said cover plate to said frame.

9. An improved article of furniture according to claim 1 wherein said vertically extending parts are provided with vertically extending screw channels and said horizontally extending parts are secured to said vertically extending parts by means of screws which are driven into said screw channels.

10. An improved article of furniture according to claim 1 wherein said metal strip comprises a base secured to said at least one edge between said outwardly extending side legs.

* * * * *